United States Patent [19]

Kallis

[11] Patent Number: 4,474,266

[45] Date of Patent: Oct. 2, 1984

[54] ELEVATORS

[75] Inventor: Bert J. Kallis, 3811 N. Pontiac Ave., Chicago, Ill. 60634

[73] Assignee: Bert J. Kallis, Chicago, Ill.

[21] Appl. No.: 405,921

[22] Filed: Aug. 6, 1982

[51] Int. Cl.[3] ..... B66B 1/26

[52] U.S. Cl. ..... 187/29 A

[58] Field of Search ..... 187/29

[56] References Cited

U.S. PATENT DOCUMENTS 2,565,880 8/1951 Pettengill et al. ..... 187/29 A
3,512,072 5/1970 Karazija et al. ..... 187/29 UX
3,947,744 3/1976 Grace et al. ..... 187/29 UX
4,351,415 9/1982 Kita ..... 187/29 B

*Primary Examiner*—Ulysses Weldon
*Assistant Examiner*—W. E. Duncanson, Jr.
*Attorney, Agent, or Firm*—Kinzer, Plyer, Dorn & McEachran

[57] ABSTRACT

A hydraulically operated elevator in which the release fluid operates a turbine which in turn operates a generator; a flywheel assures substantially constant angular velocity and a transmission is permissive of smooth startup.

1 Claim, 1 Drawing Figure

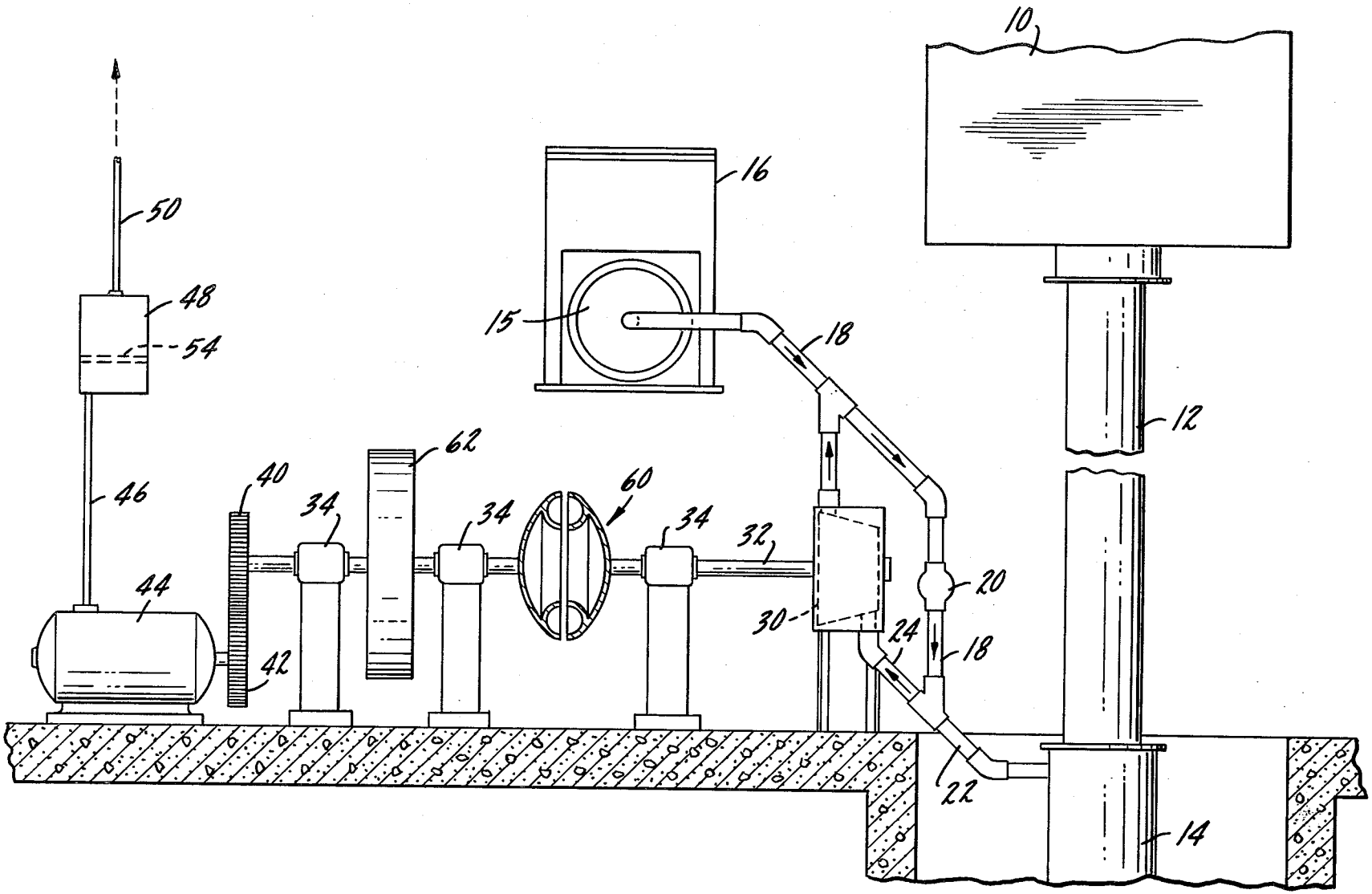
10
12
14
16
15
18
18
20
22
24
30
32
34
34
34
60
62
40
42
44
46
48
54
50

ELEVATORS

This invention relates to elevators which are operated hydraulically and such elevators may be of a size or order to service a ten-story building. I personally have knowledge of a hydraulically operated elevator with a hydraulic jack having a 20-inch diameter, the cylinder being serviced by an 8-inch hydraulic line, the arrangement being such that the cab could be advanced at the rate of 200 feet per minute. This installation required six 50 horsepower electrically driven motors to operate the hydraulic pumps. This represents a rather unusual installation and the more normal or ordinary system will have a six or eight inch jack and a two or three inch pipe; it all depends on how fast the cab is to be moved. In any event, it can be realized that the return flow of hydraulic fluid, when the jack and elevator cab are being lowered, represents stored energy of considerable magnitude and the primary object of the present invention is to recover an appreciable part of this stored energy for use in the building where the elevator system is installed.

The drawing is partly schematic and partly diagrammatic, showing an elevator cab 10 raised and lowered by a hydraulic jack 12 in a cylinder 14.

Fluid under pressure for raising the jack 12 is supplied by a pump and motor combination 15 inside a housing 16 which also contains the hydraulic reservoir (not shown). Fluid under pressure is delivered by the hydraulic pump to a pipe 18 having a one-way valve 20, the pipe 18, downstream of the one-way valve 20, being coupled to a pipe 22 which communicates with the cylinder 14.

A by-pass pipe 24 by-passes the one-way valve 20 so that return fluid from the cylinder may be returned to the reservoir as an incident to lowering the jack 12 and the elevator cab 10.

Under and in accordance with the present invention a turbine is located in the return or by-pass pipe 24 to enable a generator to be driven to recover in part the energy represented by the returning hydraulic fluid.

Thus, as shown in the drawing, a turbine 30 is interposed in the return or by-pass pipe 24 and is used in impart angular velocity to a drive shaft 32 as an incident to the flow of return hydraulic fluid. The drive shaft is supported for rotation in several bearings 34 and these bearings in turn are supported by floor-mounted posts as shown.

The drive shaft 32 at the end opposite the end connected to the turbine terminates in a drive gear 40 coupled to the driven gear 42 of a generator 44.

The generator could also have a pulley (instead of the gear 42) driven by a belt in turn driven by a pulley on shaft 32 which is substituted for the gear 40.

The energy output 46 of the generator 44 is used to supply electricity to the mains 48 of the building or dwelling in which the elevator system is installed. These mains are also supplied by the power lines 50 owned by the utility company and an interface 54, supplied by or approved by the utility company, assures that the output 46 of the generator is compatible with that of the utility company. Of course the generator 44 could also be used to charge a battery with direct current.

In order to assure that the flow of hydraulic fluid, at the commencement of return operation, is not stalled and further to assure that there is smooth torque in the drive shaft 32, a transmission 60 is interposed in the drive shaft 32. The transmission is preferably of the fluid type (but it could also be a centrifugal clutch type coupling) whereby the driven or output element of the coupling does not rotate until the torque applied by the turbine is adequate to overcome the inertia of the generator. This transmission or coupling also assures that the turbine is not loaded prematurely at the commencement of slow flow in the return fluid.

To assure a substantially constant angular velocity imparted to the gears 40 and 42, a flywheel 62 is interposed between the transmission and drive gear 40 and consequently gears 40 and 42 may be expected to turn at a substantially constant angular velocity at times when the elevator is slowing or coming to a stop during the return or "down" trip.

I claim:

1. In an elevator installation where an elevator cab is raised and lowered by a hydraulic jack in a cylinder which receives fluid under pressure from a reservoir to raise the jack and cab, and from which the fluid is returned to the reservoir when the jack and cab are to be lowered:

said installation including a return line between the cylinder and reservoir for returning hydraulic fluid to the reservoir, and a turbine in communication therewith so as to be rotated by the return flow of hydraulic fluid;

a drive shaft driven by the turbine and coupled to a generator to generate electricity;

means to couple the energy output of the generator to the electrical system of the building where the elevator is installed;

a flywheel coupled to and driven by the drive shaft to maintain a substantially constant angular velocity for the drive shaft at times when the elevator slows or stops between floors; and a transmission coupled to the drive shaft and which couples the generator to the turbine as an incident to the turbine attaining a velocity adequate to overcome the inertia of the generator.

* * * * *